US011318583B1

(12) United States Patent
Shellenberger

(10) Patent No.: US 11,318,583 B1
(45) Date of Patent: May 3, 2022

(54) RAIL SUPPORT SYSTEM AND METHOD OF USE

(71) Applicant: Rhett Shellenberger, Gainesville, TX (US)

(72) Inventor: Rhett Shellenberger, Gainesville, TX (US)

( * ) Notice: Subject to any disclaimer, the term of this patent is extended or adjusted under 35 U.S.C. 154(b) by 129 days.

(21) Appl. No.: 16/741,919

(22) Filed: Jan. 14, 2020

(51) Int. Cl.
*B25B 5/10* (2006.01)

(52) U.S. Cl.
CPC ..... *B25B 5/102* (2013.01)

(58) Field of Classification Search
CPC ..... B23Q 3/103; B25B 5/14; B25B 5/102; B25B 5/109; B25B 5/147; B23K 37/04
USPC ..... 269/71, 73, 900; 29/559, 900, 281.1, 29/282.2, 282.3
See application file for complete search history.

(56) References Cited

U.S. PATENT DOCUMENTS 6,648,318 B1 * 11/2003 Oetlinger ..... B23K 37/0435 269/41

* cited by examiner

*Primary Examiner* — Lee D Wilson
*Assistant Examiner* — Alberto Saenz
(74) *Attorney, Agent, or Firm* — Leavitt Eldredge Law Firm

(57) ABSTRACT

A rail support system includes a clamp side having a channel with a first side and a second side, the first side and second side to engage around a post; an extension extending away from the second side; a plate engaged with the extension; a tightening screw engaged with the plate and further engaged with the first side; tightening the tightening screw pulls the first side and the second side together; a cradle side having an arm attached to the channel and extending away therefrom; and a cradle support attached to and extending away from the arm; the cradle support is to receive a rail; the clamp side is to secure to post while the cradle side is configured to engage with the rail such that the post and the rail are held in position for welding together.

4 Claims, 4 Drawing Sheets

RAIL SUPPORT SYSTEM AND METHOD OF USE

BACKGROUND

1. Field of the Invention

The present invention relates generally to support systems, and more specifically to a rail support system that supports a rail positioned between two posts, thereby allowing for a user to easily secure the rail and posts together, such as by welding.

2. Description of Related Art

In many construction systems, a user must secure one or more rails between posts. For example, as shown in FIG. 1, two posts 103, 105 are provided with two rails 107, 109 secured therebetween, creating a rail and post system 101. During conventional construction methods, the user will have to support the rail and weld or otherwise secure the rail at the same time, which is cumbersome and difficult.

Accordingly, it is an object of the present invention to provide for a support system that easily allows for a user to secure the rail between the two posts, thereby freeing up the user's hands for welding the two together.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
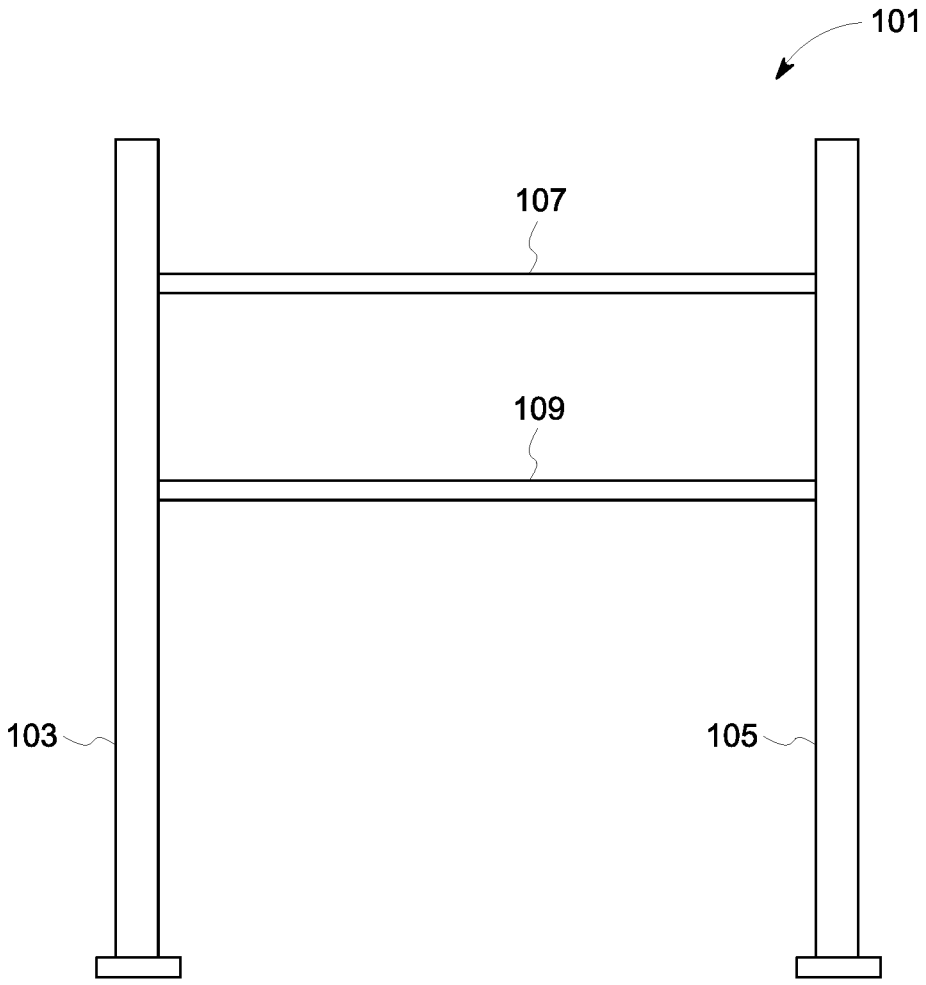
FIG. 1 (PRIOR ART)
FIG. 1 is a front view of a conventional rail and post system.
Figure 2:
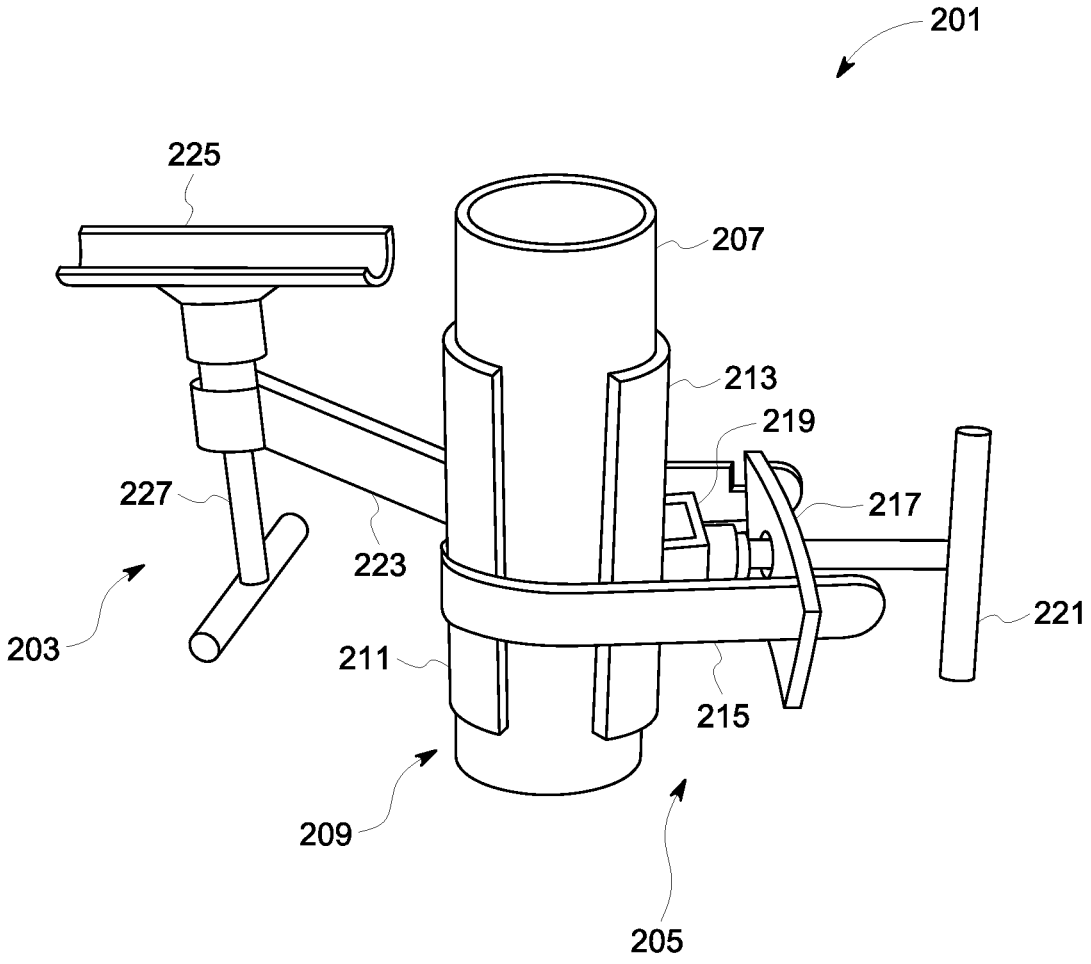
FIG. 2 is an isometric view of a support system in accordance with the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional rail and post systems. Specifically, the present invention provides for a rail support system that includes a clamp and a cradle, thereby allowing for the user to easily secure the system to a post and support a rail such that a user has free hands to secure the rail and post together. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings, FIG. 1 depicts a support system 201 in accordance with a preferred embodiment of the present application. System 201 overcomes one or more of the above discussed problems.

System 201 includes a clamp side 205 having a channel 209 with a first side 213 and a second side 211, the first side and second side are configured to engage around a post 207, thereby securing to the post. It should be appreciated that the channel can vary in diameter or the like. As shown, system 201 further includes an extension 215 extending away from the second side 211. The extension will extend around the channel as shown and engage with a plate 217 that has a tightening screw 221 extending therethrough and engaged with a brace 219 against the first side 213.

It should be appreciated that the use will rotate the tightening screw 221 to pull the channel together around the post 209. This allows for the user to secure the channel to a post at a desired location.

System 201 further includes a cradle side 203 having an arm 223 attached to the channel and extending away therefrom. It should be appreciated that the arm 223 can extend away at various angles as needed or desired based on manufacturing or functional considerations. A cradle support 225 attached to and extending away from the arm 223 via a second tightening screw 227. It should be appreciated that this second tightening screw provides for adjustment to the cradle support 225.

Figure 3:
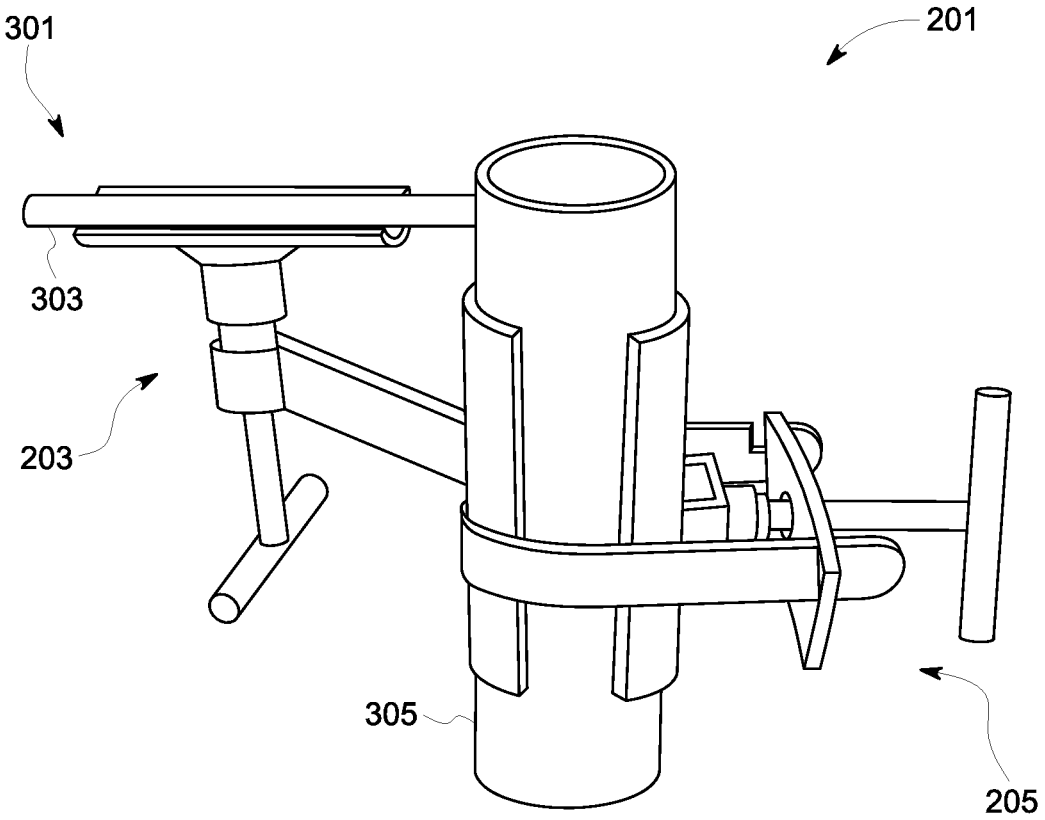
FIG. 3 is an isometric view of the system of FIG. 2 with a rail supported therein.

In FIG. 3, the support system 201 is shown engaged with a rail 303 and a post 305. As shown, the rail 303 is held in a desired position 301 relative to post 305. The user then has free hands to secure the rail and post together.

Figure 4:
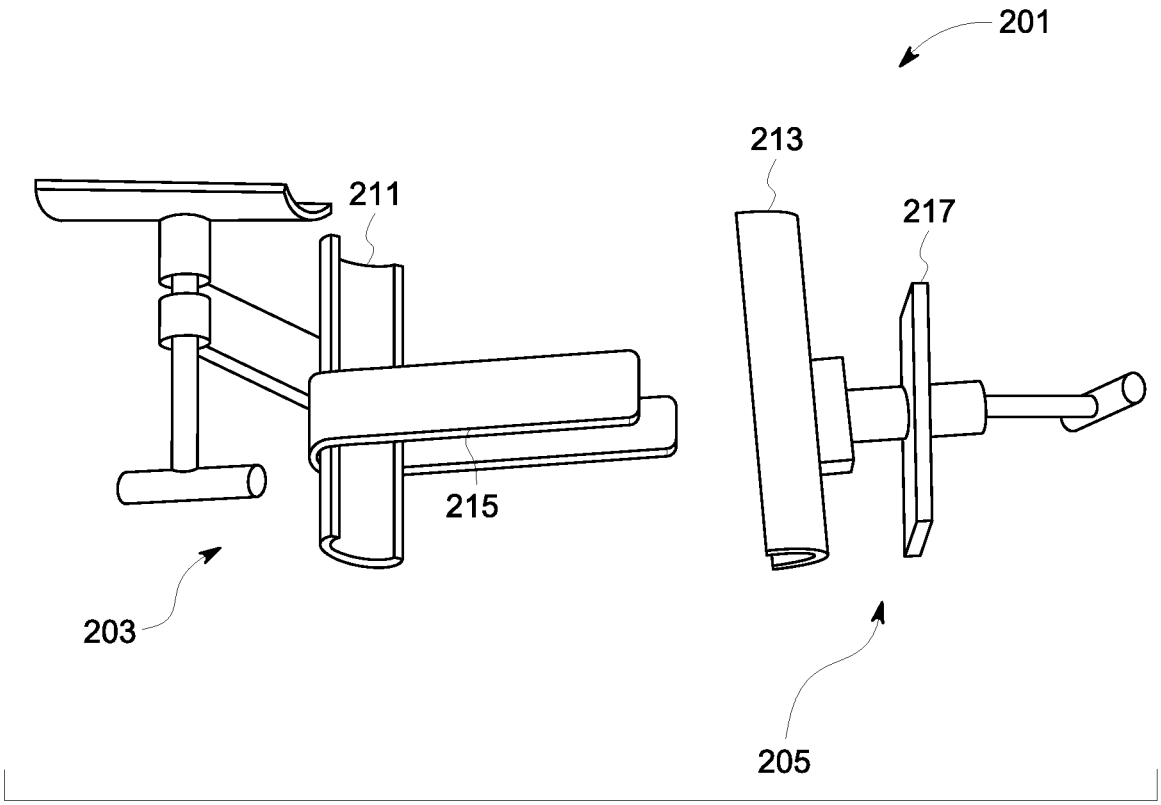
FIG. 4 is a front view of the system of FIG. 2 with the channel separated.

In FIG. 4, the system 201 is shown with the first side 213 and the second side 211 disengaged. As shown, the sides come apart, which allows for a user to secure the system to a post at a desired location easily.

Figure 5:
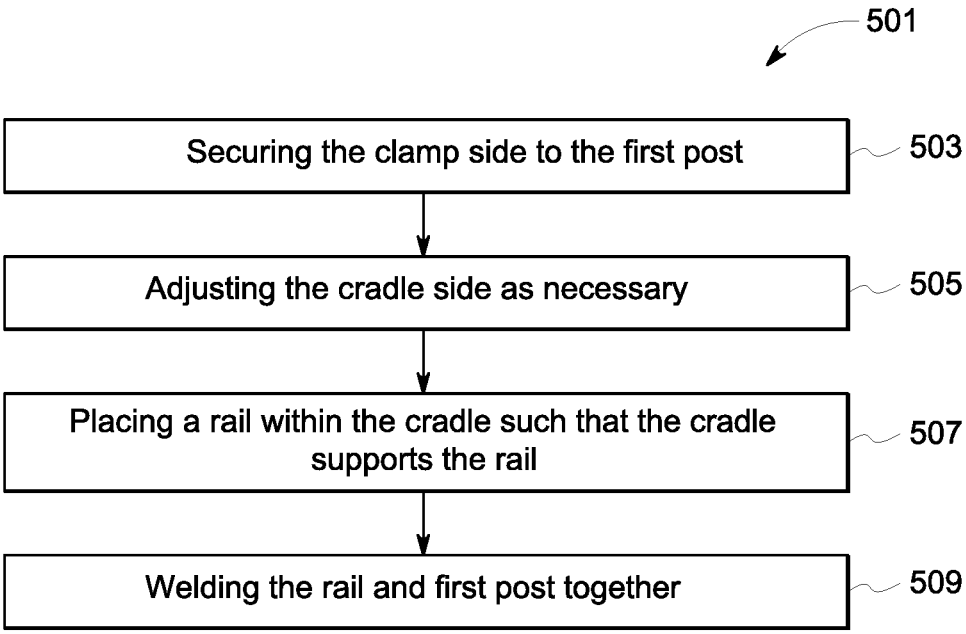
FIG. 5 is a flowchart of a method of use of the system of FIG. 2.

In FIG. 5, a flowchart 501 depicts the method of use of system 201. During use, the user will secure the clamp side to a first post, as shown with box 503. The user will then adjust the cradle side as necessary to the correct position, as shown with box 505. The user can then proceed to place a rail within the cradle support and secure the rail and post together, such as through welding, as shown with boxes 507, 509.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A rail support system, comprising:

a clamp side having:

a channel formed with a first side and a second side, the first side and second side configured to engage around a post;

an extension having a curved section curved around the second side of the channel, and having a first end and a second end extending away from the second side;

a plate engaged with the first end and the second end of the extension, the plate engaged opposite the curved section of the extension such that the channel is positioned between the curved section and the plate;

a tightening screw engaged with the plate and further engaged with the first side of the channel;

wherein tightening the tightening screw pulls the first side and the second side together, by applying pressure to the second side of the channel via the curved section of the extension and pressure to the first side;

a cradle side having:

an arm attached to the channel and extending away therefrom; and a cradle support attached to and extending away from the arm, the cradle support being vertically adjustable relative to the channel;

wherein the cradle support is configured to receive a rail;

wherein the clamp side is configured to secure to the post while the cradle side is configured to engage with the rail such that the post and the rail are held in position for welding together.

2. The system of claim 1, further comprising:

a second tightening screw extending through the arm and engaged with the cradle support;

wherein the second tightening screw provides adjustment of the cradle support.

3. A rail and post support system, comprising:

a first post;

a rail to be secured to the first post;

a rail support apparatus, comprising:

a clamp side having:

a clamp side having:

a channel formed with a first side and a second side, the first side and second side configured to engage around a post;

an extension having a curved section curved around the second side of the channel, and having a first end and a second end extending away from the second side;

a plate engaged with the first end and the second end of the extension, the plate engaged opposite the curved section of the extension such that the channel is positioned between the curved section and the plate;

a tightening screw engaged with the plate and further engaged with the first side of the channel;

wherein tightening the tightening screw pulls the first side and the second side together, by applying pressure to the second side of the channel via the curved section of the extension and pressure to the first side;

a cradle side having:

an arm attached to the channel and extending away therefrom; and a cradle support attached to and extending away from the arm, the cradle support being vertically adjustable relative to the channel;

wherein the cradle support is configured to receive a rail;

wherein the clamp side is configured to secure to the first post while the cradle side is configured to engage with the rail such that the first post and the rail are held in position for welding together.

4. A method of holding a first post and a rail in place for welding, the method comprising:

providing the system of claim 1;

securing the clamp side to the first post via the channel;

adjusting the cradle side;

placing the rail within the cradle; and welding the rail and the first post together.

* * * * *